United States Patent [19]

Ellis et al.

[11] 4,077,692

[45] Mar. 7, 1978

[54] INTEGRALLY FORMED CONNECTOR

[75] Inventors: Roger M. Ellis, Atherton, Calif.; Werner M. Allgaier, Westerham, Germany

[73] Assignee: Raychem Corporation, Menlo Park, Calif.

[21] Appl. No.: 786,120

[22] Filed: Apr. 8, 1977

Related U.S. Application Data

[63] Continuation of Ser. No. 644,588, Dec. 29, 1975, abandoned.

[51] Int. Cl.[2] ..... H01R 13/58

[52] U.S. Cl. ..... 339/103 M; 339/DIG. 1

[58] Field of Search ..... 339/102, 176 M, 218, 339/DIG. 1, 103; 174/DIG. 8

[56] References Cited

U.S. PATENT DOCUMENTS

| | | | |
|---|---|---|---|
| 3,324,230 | 6/1967 | Sherlock | 339/DIG. 1 |
| 3,493,916 | 2/1970 | Hansen | 339/176 M |
| 3,582,868 | 6/1971 | Trimble et al. | 339/DIG. 1 |

*Primary Examiner*—Joseph H. McGlynn
*Attorney, Agent, or Firm*—Lyon & Lyon

[57] ABSTRACT

A connector for electrical conductors including a unitary body having a heat recoverable portion to assist in termination of associated conductors. Electrical contacts extend through the connector body from positions in the connector head located for facile union with contacts of a compatible connector. At the other end, the electrical contacts extend to a position along a termination support member which rigidly defines specific locations for termination of conductor ends with each electrical contact. The heat recoverable portion of the body is adjacent these termination positions such that the connector may constrict under the application of heat to securely position the terminated conductors.

5 Claims, 5 Drawing Figures

INTEGRALLY FORMED CONNECTOR

This is a continuation of application Ser. No. 644,588, filed Dec. 29, 1975, now abandoned.

BACKGROUND OF THE INVENTION

The present invention is directed to electrical connectors.

With increasing use of modular assembly techniques for electrical systems and the like, electrical connectors have become more and more important. Further, with this increase in importance, it has become necessary to improve the structures and techniques for mass production in order that reliable and inexpensive electrical connectors can be provided.

To reduce the cost of such electrical connectors, it has been known to cast contacts into connector heads such that they extend rearwardly of the connector head for association with a separate multiple termination module. The multiple termination modules are often heat recoverable and employ a socket for assembly with the back end of a connector head such that the cast-in-place contacts extend into the multiple termination module. Conductor ends may then be terminated against these contacts in the multiple termination module. The multiple termination module is capable of recovery to tightly hold the conductor ends and the contacts in contact with each other during the soldering operation.

The practice of incorporating heat shrinkable multiple termination modules with separate connector heads has been found to be satisfactory for the fabrication of electrical connectors. However, the several parts involved must be separately fabricated and assembled. The separate fabrication and later assembly is inevitably time consuming and may lead to undesired variations in quality of the final product.

SUMMARY OF THE INVENTION

The present invention is directed to an electrical connector which includes the connector head and the multiple termination module in a unitary molding. Contacts may also be molded into the unitary molding. In the termination portion of the unitary molding, a closure member which has a heat recoverable portion is employed with a rigid termination support member to provide conductor termination cavities which may be constricted upon the application of heat to firmly position conductor ends with the contacts. The rigid termination support member is not heat recoverable and thereby provides a reference position upon which the contacts rest and from which the closure member is expanded during preparation of heat recoverable material. The unitary structure of the present invention thus provides a dimensionally accurate structure requiring less labor and costs both in the fabrication of the connector and in its use.

Accordingly, it is an object of the present invention to provide an improved electrical connector wherein the connector head and the multiple termination module are of unitary construction.

It is another object of the present invention to provide an electrical connector of unitary construction which provides a fixed reference member for facile multiple termination of conductor ends.

Other and further objects and advantages will appear hereinafter.

DETAILED DESCRIPTION OF THE PREFERRED EMBODIMENT

Figure 1:
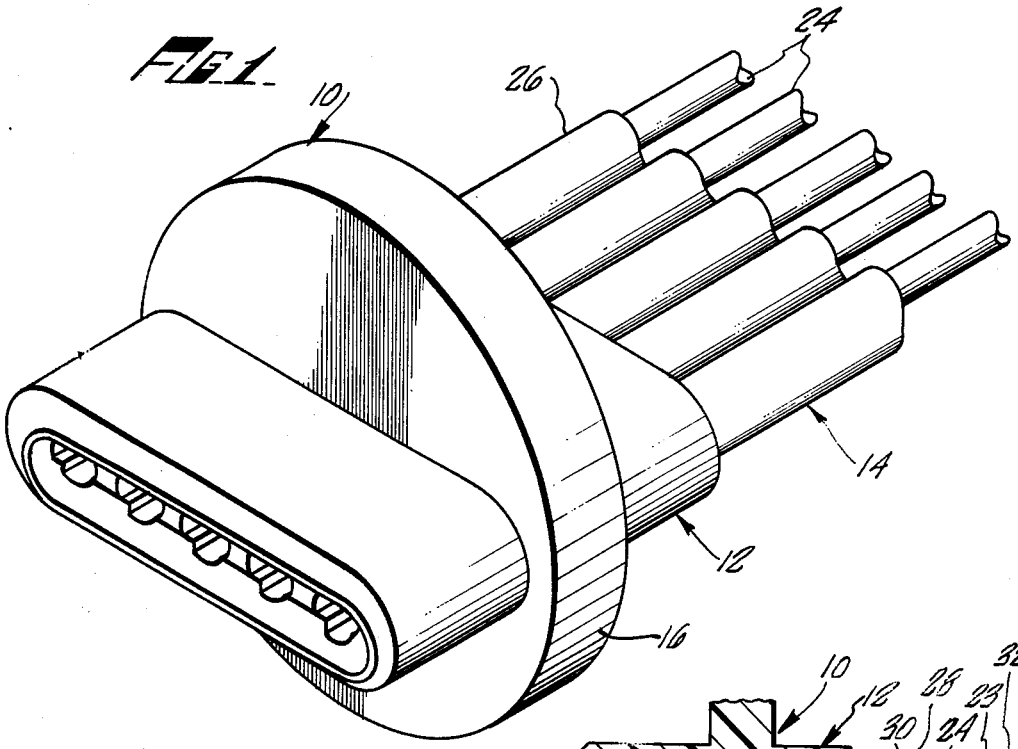
FIG. 1 is a perspective view of the present invention with terminated wires.
Figure 2:
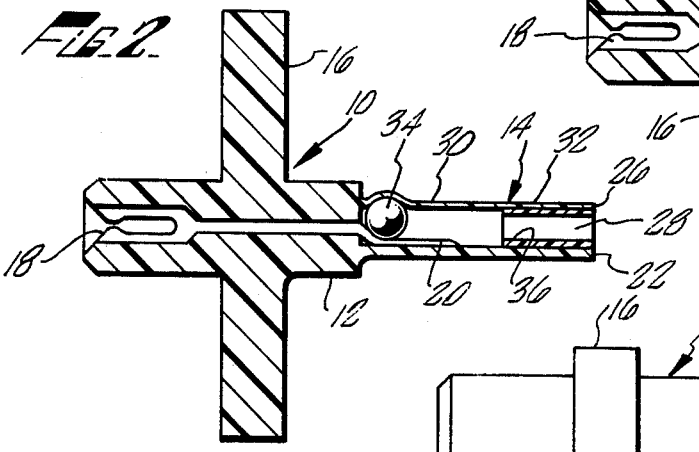
FIG. 2 is a sectional elevation of the present invention prior to assembly with electrical conductors.
Figure 3:
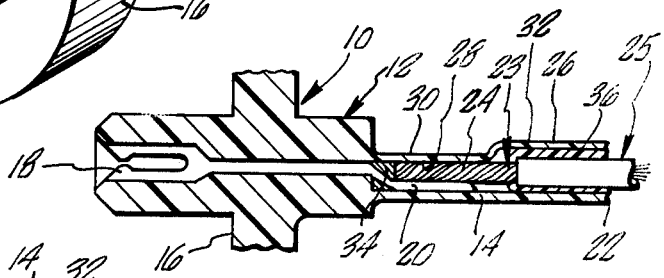
FIG. 3 is a sectional elevation of the present invention with terminated electrical conductors.

Turning in detail to the drawings, a connector body, generally designated 10, is disclosed as including in unitary construction a connector head 12 and a termination portion 14. A cylindrical flange 16 is also shown as an optional component in this embodiment located centrally on the connector head 12. The connector head 12 performs the function of providing a plug with fixed contacts for facile union with contacts of a compatible connector. The termination portion 14 acts to receive conductors 24 bared at the ends, hold these conductors resiliently in association with the connector body 10 and retain the connector ends in electrically conductive association with the connector contacts 18. The cylindrical flange 16 is provided for mounting convenience and may be replaced by any other convenient method for mounting the connector body 10 where mounting is a requisite function of the connector.

The connector head 12 includes a plurality of contacts 18. The contacts may be molded, snapped or pressed into the connector head 12. The arrangement of the heads of the contacts 18 is designed for facile union with contacts of a compatible connector. The heads of the contacts 18 may have a U-shaped socket as illustrated in the present embodiment or may constitute pins which protrude from the connector head 12. An extended portion 20 of each contact 18 protrudes from the back side of the connector head 12. These protruding portions 20 are formed to lay against the bottom of the temination cavities associated with the contacts 18. The formed portion of the contact 18 also retains the contact in the connector head 12.

The termination portion 14 includes a termination support member 22 which extends from the connector head 12. The termination support member 22 is generally planar in construction and is sufficiently rigid to prevent easy distortion of the termination portion 14 by loads placed on the conductors 24. The termination support member 22 is of sufficient length to allow for support of the bared ends of the electrical conductors 24. To accomplish this support, a length of insulated conductor is also supported with each bared end on the termination support member. The contacts 18 are formed and flattened such that the extended portion 20 of each contact 18 extends from the connector head 12 and immediately drops to a contiguous position along the termination support member 22. Because the termination support member 22 is rigid in nature, the positioning of the extended portion 20 of each contact 18 is fixed and can be maintained at a specific location within the termination portion 14 of the connector body 10. This facilitates the placement of the bared ends of conductors 24 in the termination portion 14 adjacent the extended portions 20 of the contacts 18.

A closure member 26 also extends from the connector head 12 as part of the termination portion 14. The closure member 26 is coextensive with the termination support member 22 and is alternately contiguous with and then spaced from the termination support member 22 such that elongated cavities are formed between the contiguous portions of the closure member 26 and the termination support member 22. These elongated cavities form conductor termination cavities 28 for receipt of the bared ends and a length of the insulated portions of the conductors 24.

Figure 5:
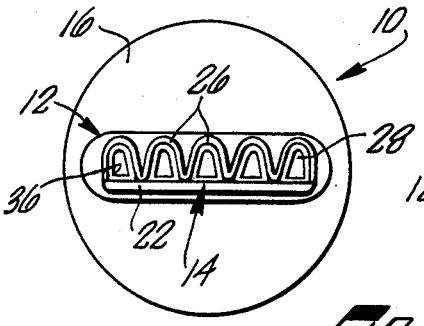
FIG. 5 is a back elevation of the present invention prior to assembly with electrical conductors.
Figure 4:
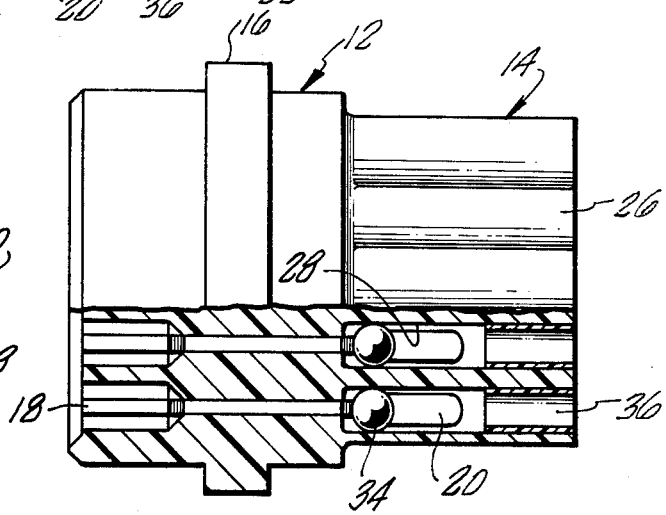
FIG. 4 is a plan view of the present invention with a portion of the device broken away for clarity.

The closure member 26 is heat recoverable and may be made so, for example, by irradiating the entire part to create sufficient crosslinking according to conventional practices. Inherently heat recoverable materials may also be used. In its fully recovered state, the closure member 26 forms the conductor termination cavities 28 such that the extended portions 20 of the contacts 18 and the conductors 24 will not fit therein. However, the closure member 26 is expanded away from the termination support member 22 as can best be seen in FIG. 5 at each conductor termination cavity 28. The closure member 26 is expanded away from the termination support member 22 in each conductor termination cavity 28 such that the conductor termination cavities 28 will easily accommodate extended portions 20 of contacts 18 as well as the bared ends and a length of the insulated portions of the conductors 24. Thus, the conductors 24 may be easily introduced into the conductor termination cavities 28 so that the conductor 24 will overlap the extended portion 20 of the conductor 18 and be forced against the solder ball 34.

Once the proper conductors are positioned in the connector, the closure member 26 is subjected to sufficient heat to allow recovery about the extended portion 20 of the contacts 18 and the portions of the conductors 24 which extend into the termination portion 14. A compression loading is placed on the ends of the conductors 24 and the contacts 18 upon recovery to insure that the two ends are forced together during the termination process to provide an electrical connection therebetween. A flux-coated ball of solder 34 may also be located within the expanded conductor termination cavities 28. The ball of solder 34 is slightly larger than the area between the extended portion 20 of contract 18 and closure member 26. Thus, the ball of solder 34 can be pressed into cavity 26 and retained. These flux-coated balls of solder 34 melt and flow when the closure member 26 is subjected to heat recovery to provide a solder terminated joint between the ends of the conductors 24 and the extended portion 20 of contacts 18.

The wall thickness of the closure member 26 is at least one-half the wall thickness of the termination support member 22. This insures that the closure member 26 will distort rather than the termination support member 22 allowing a variety of connector sizes to be terminated. Thus, the termination support member 22 forms a base reference from which the closure member 26 may be expanded to provide the heat recoverable property to the conductor termination cavities 28. The termination support member 22 also provides the reference for the location of the extended portions 20 of the contacts 18 as more fully discussed above.

At the outer end of the conductor termination cavities 28, liners 36 of adhesive extend about the walls of the conductor termination cavities 28. Conveniently, hot melt adhesives may be employed. As the termination portion 14 is subjected to heat for recovery of the closure member 26, the hot melt adhesive also is melted and resolidifies about the conductors 24 only at point 23 to seal on the conductor 24 and on wire 25. The liners of hot melt adhesive 36 are of sufficient size before heating of the termination portion 14 so that conductors 24, which may be of various sizes, may pass easily therethrough. Once melted onto the conductors 24, at point 23 and on wires 25, the hot melt adhesive 36 acts as a seal and strain relief between the walls of the conductor termination cavities 28 and the terminated conductors 24 and contacts 18 such that stress is not concentrated along one specific line when the wires 25 are subjected to side loading and the like.

Thus, a new and improved electrical connector is provided which is fabricated of a unitary connector body and provides for accurate termination, sealing and strain relieving of electrical conductors all at one time in the electrical connector. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. An electrical connector comprising a connector body, said connector body including a connector head and a conductor termination portion extending from said connector head, said conductor termination portion including a termination support member and a closure member, said termination support member and said closure member extending coextensively from said connector head and being mutually contiguous along substantially parallel lines, said closure member having arched portions between said substantially parallel lines to form conductor termination cavities, at least said arched portions of said closure member being heat recoverable and said termination support member being not heat recoverable, said termination support member having a wall thickness of at least twice the wall thickness of the heat recoverable portion of said closure member, said heat recoverable portion of said closure member being recoverable to constrict each said conductor termination cavity upon the application of heat.

2. The electrical connector of claim 1 wherein said connector body is of unitary construction.

3. The electrical connector of claim 1 wherein said conductor termination cavity includes a flux covered ball of solder positioned therein and a lining of hot melt adhesive at one end of said cavity.

4. The electrical connector of claim 1 further comprising an electrical contact extending from each said conductor termination cavity through said connector head for facile union with contacts of a compatible connector.

5. The electrical connector of claim 4 wherein each said electrical contact extends into said conductor termination cavity adjacent said termination support member and displaced from said closure member.

* * * * *